US007913361B2

(12) United States Patent
Tomiji

(10) Patent No.: US 7,913,361 B2
(45) Date of Patent: Mar. 29, 2011

(54) DOOR HANDLE DEVICE

(75) Inventor: Katsuyasu Tomiji, Kamakura (JP)

(73) Assignee: NIFCO Inc., Yokohama-Shi, Kanagawa (JP)

( * ) Notice: Subject to any disclaimer, the term of this patent is extended or adjusted under 35 U.S.C. 154(b) by 266 days.

(21) Appl. No.: 12/087,986

(22) PCT Filed: Dec. 22, 2006

(86) PCT No.: PCT/JP2006/325655

§ 371 (c)(1),
(2), (4) Date: Jul. 18, 2008

(87) PCT Pub. No.: WO2007/088687

PCT Pub. Date: Aug. 9, 2007

(65) Prior Publication Data

US 2009/0013501 A1 Jan. 15, 2009

(30) Foreign Application Priority Data

Feb. 2, 2006 (JP) ..... 2006-026123

(51) Int. Cl.
*E05B 1/00* (2006.01)

(52) U.S. Cl. ..... 16/412; 16/54; 292/336.3

(58) Field of Classification Search ..... 16/412, 16/110.1, 54, 50, 49, 51, 82, DIG. 21; 292/336.3, 292/DIG. 23, DIG. 31; 188/322.5
See application file for complete search history.

(56) References Cited

U.S. PATENT DOCUMENTS

| | | | | |
|---|---|---|---|---|
| 3,020,075 | A * | 2/1962 | Johnstone et al. | 292/336.3 |
| 7,216,402 | B2 * | 5/2007 | Nishiyama et al. | 16/412 |
| 7,377,500 | B2 * | 5/2008 | Tomiji et al. | 267/64.15 |
| 2005/0251959 | A1 * | 11/2005 | Nishiyama et al. | 16/110.1 |

FOREIGN PATENT DOCUMENTS

| | | |
|---|---|---|
| JP | H01-250571 | 10/1989 |
| JP | H02-35107 B2 | 8/1990 |
| JP | 2000-054692 | 2/2000 |
| JP | 2005-188693 | 7/2005 |
| JP | 2005-351071 | 12/2005 |

* cited by examiner

*Primary Examiner* — William L. Miller
(74) *Attorney, Agent, or Firm* — Manabu Kanesaka

(57) ABSTRACT

There is disposed a damper 7, which provides a resistance to a retracting movement of a piston 71. A door opening lever 2 has a pressing part 2*c* formed with a cam surface, which is configured so as to have a distance from a swingable shaft 2*a* gradually increasing toward a cam end 2*e*. The damper 7 is configured so that a piston rod 72 is fixed to a depth end of a housing 9, that a gap 9*c* is formed between an outer wall of the cylinder 70 and an inner wall of the housing 9, and that the cylinder 70 has a depth end 70*a* constantly brought into press-contact with the cam surface 2*d* of the door opening lever 2 under a biasing action. When the door opening lever 2 is not subjected to pulling operation, a portion of the cam surface 2*d* close to the cam end 2*e* is brought into press-contact with the depth end 70*a* of the cylinder 70 to retract the piston 71 into the cylinder 70 at the maximum.

6 Claims, 6 Drawing Sheets

DOOR HANDLE DEVICE

TECHNICAL FIELD

The present invention relates to an improved door handle system, which is incorporated in an automotive door, and which prevents a door opening lever from swiftly returning to a position prior to pulling operation when stopping the pulling operation to the door opening lever for opening the door.

BACKGROUND ART

The door opening lever of an automotive door is configured to be linked to the door latch of the door so that the door latched by the door latch is capable of being released from a closed state by pulling operation. The door opening lever is configured to be biased to be returned to a position prior to pulling operation by a spring when the pulling operation is stopped. If the door opening lever is returned under the biasing action of the spring without being damped when the pulling operation is stopped, the automobile is subjected to trouble, such as the generation of an impulsive sound, damaging the quality image of the automobile. From this point of view, it has been proposed to dispose a buffer in the form of bellows so as to extend between a bracket disposed in a door and an internal end of a door opening lever disposed at a deeper position of the door than the swingable shaft for the door opening lever, and to utilize air resistance to slowly collapse the bellows so as to damp the returning action of the door opening lever when the bellows is expanded by pulling operation, followed by stopping the pulling operation (see Patent Document 1).

The system disclosed by Patent Document 1 is configured so that a first pair of one end of the buffer and the internal end of the door opening lever, and a second pair of the other end of the buffer and the bracket are coupled by shafts, respectively. If an internal part in the door is frozen in, e.g. midwinter, there has been a case where these coupled portions are fixedly coupled together to make the pulling operation of the door opening lever difficult.

Patent Document 1: JP-B-2-35107

DISCLOSURE OF THE INVENTION

Problems to be Solved by the Invention

It is a main object of the present invention to provide a door handle system with a damping function, which is capable of adequately damping the returning action of a door opening lever to a position prior to pulling operation by a biasing force when stopping the pulling operation to the door opening lever, and which is capable of performing the pulling operation or the like for the door opening lever without trouble even if an internal part is frozen in the door.

Means to Solve the Problem

In order to attain the above-mentioned object, according to a first aspect of the present invention, there is provided a door handle system, which comprises:

(1) a door opening lever swingably assembled to a door panel and configured to be linked to a door latch so as to open a door by pulling operation;

(2) a damper including a cylinder, a piston, a piston rod and a biasing member for constantly biasing the piston in a direction away from a depth end of the cylinder, the damper being configured so as to provide a resistance of a fluid to a retracting movement of the piston against the biasing action, the fluid being sealed in the cylinder; and (3) a housing for the damper, fixed to the door panel;

(4) wherein the door opening lever has an operating part formed on one end thereof and a pressing part formed on the other end thereof with respect to a swingable shaft, the pressing part having a cam surface, the cam surface being configured so as to have a distance from the swingable shaft gradually increasing toward a cam end;

(5) wherein the damper is configured so that the piston rod is fixed to a depth end of the housing, that a gap is formed between an outer wall of the cylinder and an inner wall of the housing, and that the cylinder has a depth end constantly brought into press-contact with the cam surface of the door opening lever under the biasing action; and (6) wherein the damper is configured so that a portion of the cam surface close to the cam end is brought into press-contact with the depth end of the cylinder to retract the piston into the cylinder at a maximum when the door opening lever is not subjected to pulling operation.

In accordance with the first aspect of the present invention, when the door opening lever is pulled, such a portion of the cam surface close to the swingable shaft is positioned in front of the depth end of the cylinder with the result that the cylinder moves forward, i.e. moves in a direction to protrude from the housing under the biasing action of the biasing member, following the swinging operation of the door opening lever. The damper applies no damping force to the pulling operation. When the pulling operation of the door opening lever is stopped, the door opening lever is returned to such a position prior to pulling operation. When the door opening lever is returned to such a position prior to pulling operation, such a portion of the cam surface close to the cam end is positioned in front of the depth end of the cylinder with the result that the cylinder is retracted, i.e. is moved in a direction to be pressed into the housing against the biasing action of the biasing member. In this time, the damper applies a damping force to make the returning movement of the door opening lever slow. Even if an internal part in the door handle system is frozen, not only the door opening lever can be pulled without trouble but also the damper can be operated without trouble since the depth end of the cylinder forming the damper is simply brought into contact with the cam surface of the door opening lever and since the gap is formed between the outer wall of the cylinder and the inner wall of the housing.

In the door handle system according to the first aspect of the present invention, at least the depth end of the cylinder may be formed of a plastic material having a small friction coefficient. In this case, even if the depth end of the cylinder is constantly brought into press-contact with the cam surface of the pressing part of the door opening lever, the door opening lever is not prevented from swinging.

In order to attain the above-mentioned object, according to a second aspect of the present invention, there is provided a door handle system, which comprises:

(1) a door opening lever swingably assembled to a door panel and configured to be linked to a door latch so as to open a door by pulling operation;

(2) a damper including a cylinder, a piston, a piston rod and a biasing member for constantly biasing the piston in a direction away from a depth end of the cylinder, the damper being configured so as to provide a resistance of a fluid to a retracting movement of the piston against the biasing action, the fluid being sealed in the cylinder; and (3) a support for the damper, fixed to the door panel;

(4) wherein the door opening lever has an operating part formed on one end thereof and a pressing part formed on the other end thereof with respect to a swingable shaft, the pressing part having a cam surface, the cam surface being configured so as to have a distance from the swingable shaft gradually increasing toward a cam end;

(5) wherein the damper is configured so that the cylinder is fixed to the support, and that the piston rod has an outer end constantly brought into press-contact with the cam surface of the door opening lever under the biasing action; and (6) wherein the damper is configured so that a portion of the cam surface close to the cam end is brought into press-contact with the outer end of the cylinder to retract the piston into the cylinder at a maximum when the door opening lever is not subjected to pulling operation.

In accordance with the second aspect of the present invention, when the door opening lever is pulled, such a portion of the cam surface close to the swingable shaft is positioned in front of the outer end of the piston rod with the result that the piston rod moves forward, i.e. moves in a direction to protrude from the support under the biasing action of the biasing member, following the swinging operation of the door opening lever. The damper applies no damping force to the pulling operation. When the pulling operation of the door opening lever is stopped, the door opening lever is returned to such a position prior to pulling operation. When the door opening lever is returned to such a position prior to pulling operation, such a portion of the cam surface close to the cam end is positioned in front of the outer end of the piston rod with the result that the piston rod is retracted against the biasing action of the biasing member. In this time, the damper applies a damping force to make the returning movement of the door opening lever slow. Even if an internal part in the door handle system is frozen, not only the door opening lever can be pulled without trouble but also the damper can be operated without trouble since the outer end of the piston rod forming the damper is simply brought into contact with the cam surface of the door opening lever and since the piston rod is not brought into contact with the support.

In order to attain the above-mentioned object, according to a third aspect of the present invention, there is provided a door handle system, which comprises:

(1) a door opening lever swingably assembled to a door panel and configured to be linked to a door latch so as to open a door by pulling operation;

(2) a linearly moving member supported by the door panel, the linearly moving member being configured so as to move back and forth;

(3) a biasing member for the linearly moving member; and (4) a damper including a main body and a pinion rotatably supported by the main body, the damper being configured so as to provide a resistance of a fluid to a rotation of the pinion, the fluid being sealed in the main body;

(5) wherein one of the linearly moving member and the door panel has the damper fixed thereto, and the other is formed with a rack engageable with the pinion forming the damper;

(6) wherein the door opening lever has an operating part formed on one end thereof and a pressing part formed on the other end thereof with respect to a swingable shaft, the pressing part having a cam surface, the cam surface being configured so as to have a distance from the swingable shaft gradually increasing toward a cam end;

(7) wherein the linearly moving member has a front end constantly brought into press-contact with the cam surface of the door opening lever under a biasing action of the biasing member; and (8) wherein the door opening lever is configured so that a portion of the cam surface close to the cam end is brought into press-contact with the front end of the linearly moving member to retract the linearly moving member at a maximum when the door opening lever is not subjected to pulling operation.

In accordance with the third aspect of the present invention, when the door opening lever is pulled, such a portion of the cam surface close to the swingable shaft is positioned in front of the front end of the linearly moving member with the result that the linearly moving member moves forward under the biasing action of the biasing member, following the swinging operation of the door opening lever. The damper applies no damping force to the pulling operation. When the pulling operation of the door opening lever is stopped, the door opening lever is returned to such a position prior to pulling operation. When the door opening lever is returned to such a position prior to pulling operation, such a portion of the cam surface close to the cam end is positioned in front of the front end of the linearly moving member with the result that the linearly moving member is retracted against the biasing action of the biasing member. In this time, the rotation of the pinion caused by the retracting movement is damped by the fluid with the result that the returning movement of the door opening lever is made slow. Even if an internal part in the door handle system is frozen, not only the door opening lever can be pulled without trouble but also the damper can be operated without trouble since the front end of the linearly moving member forming the damper is simply brought into contact with the cam surface of the door opening lever.

EFFECTS OF THE INVENTION

The door handle system according to the present invention is configured not only to adequately damp the returning movement of the door opening lever to the position prior to pulling operation when stopping the pulling operation to the door opening lever but also to simply press the cylinder or the like forming the damper to the pressing part of the door opening lever under the biasing action of the biasing member. In accordance with the door handle system of the present invention, even if an internal part in the door is frozen, it is possible to perform the pulling operation or the like for the door opening lever without trouble since the pressed portions are prevented from being fixed.

BEST MODE FOR CARRYING OUT THE INVENTION

Now, embodiments for carrying out the present invention will be described on the basis of FIG. 1 to FIG. 10.

Figure 1:
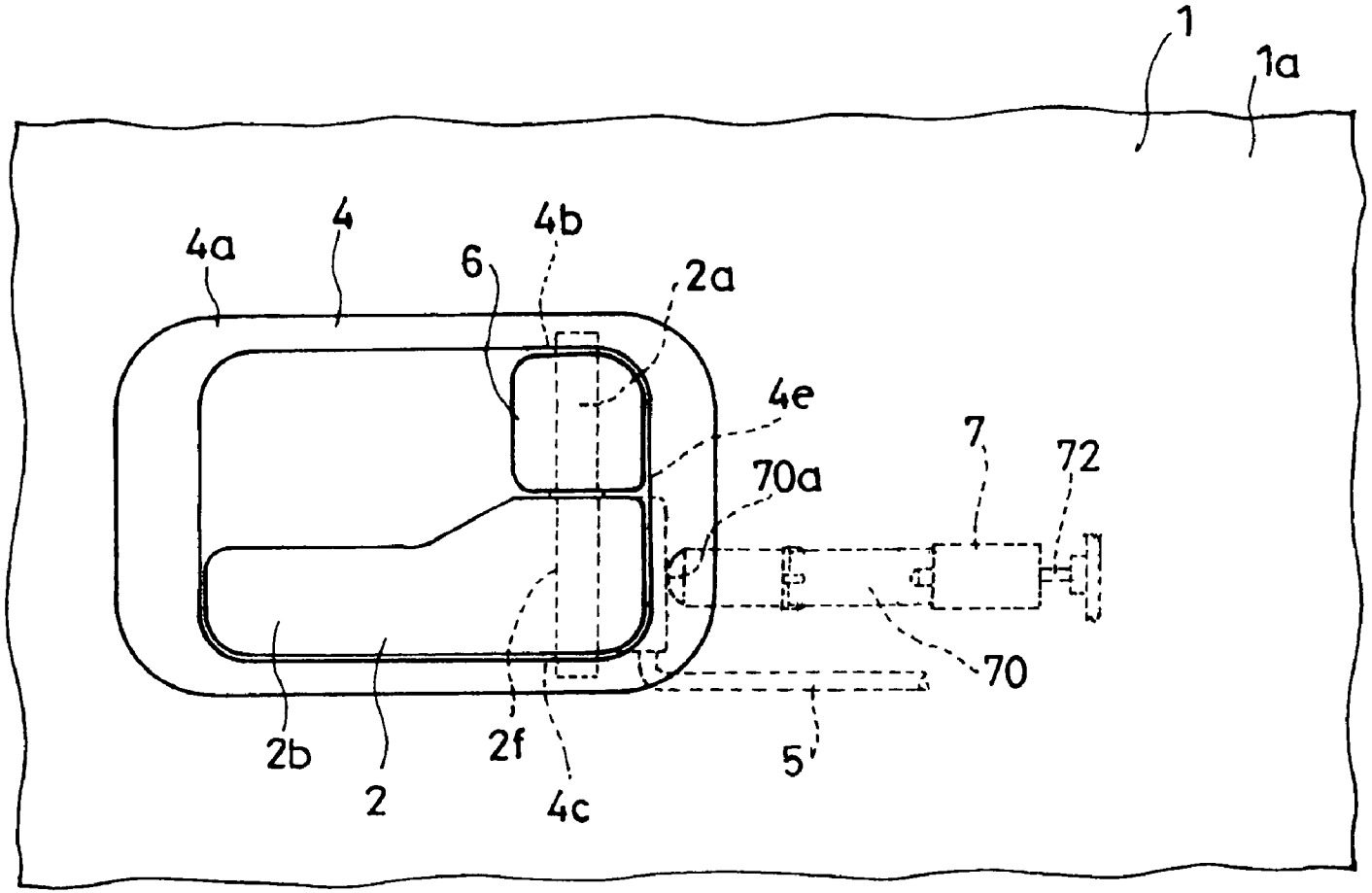
FIG. 1 is a front view showing the structure of the door handle system according to a first embodiment of the present invention.
Figure 2:
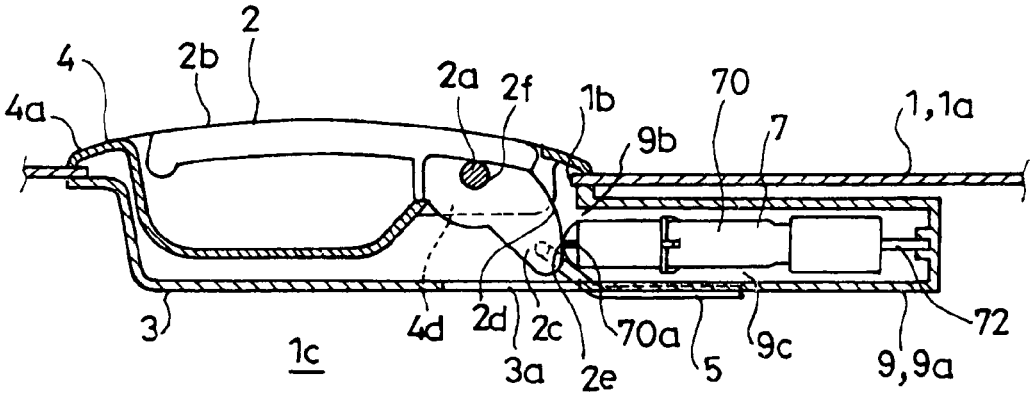
FIG. 2 is a cross-sectional view showing the structure of the door handle system according to the first embodiment.
Figure 3:
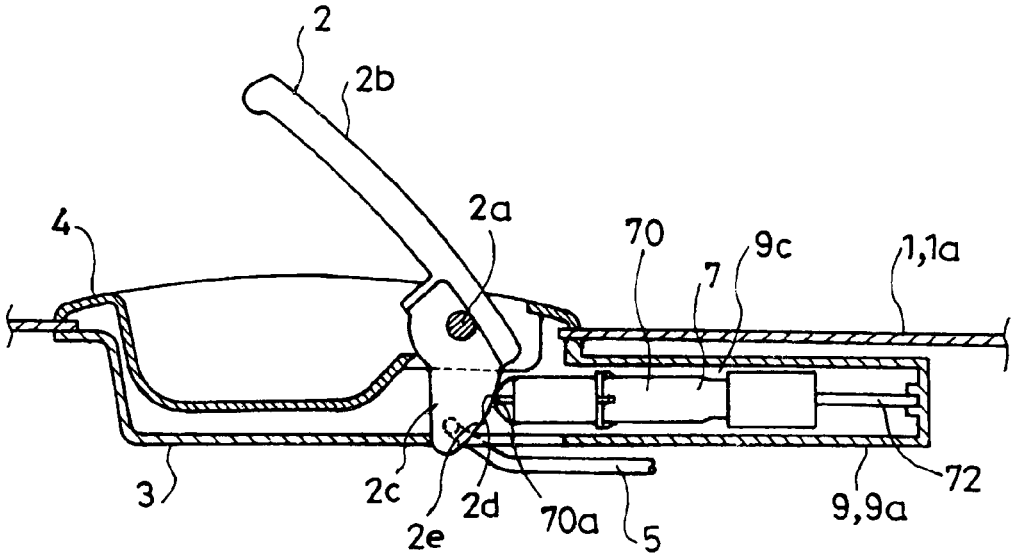
FIG. 3 is another cross-sectional view showing the structure of the door handle system according to the first embodiment.
Figure 4:
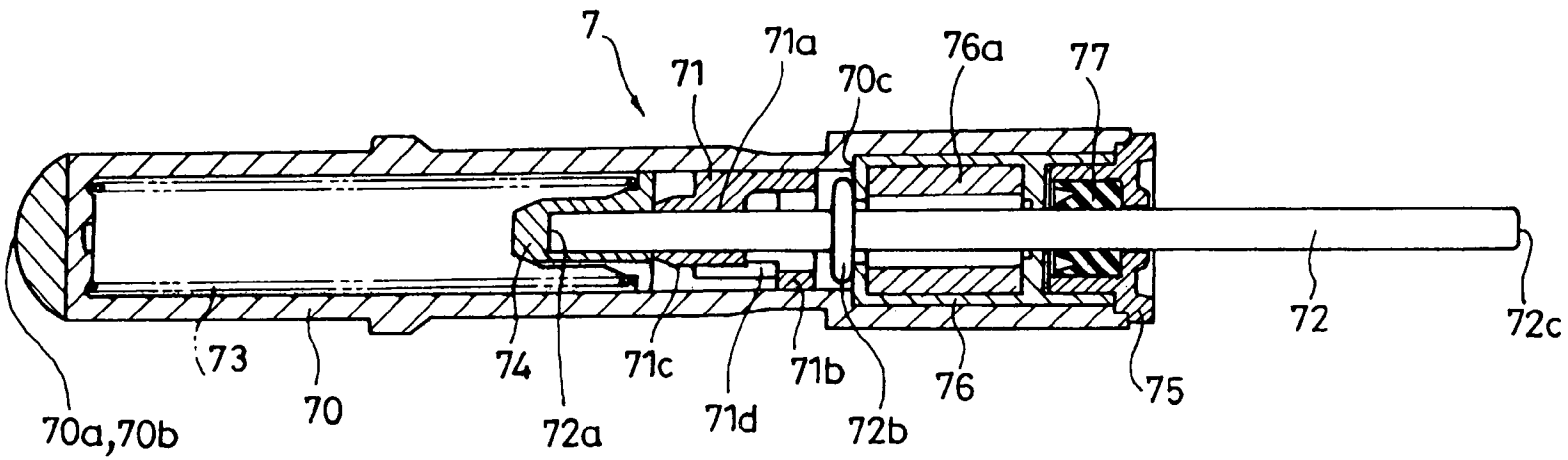
FIG. 4 is a cross-sectional view showing the structure of a damper.
Figure 5:
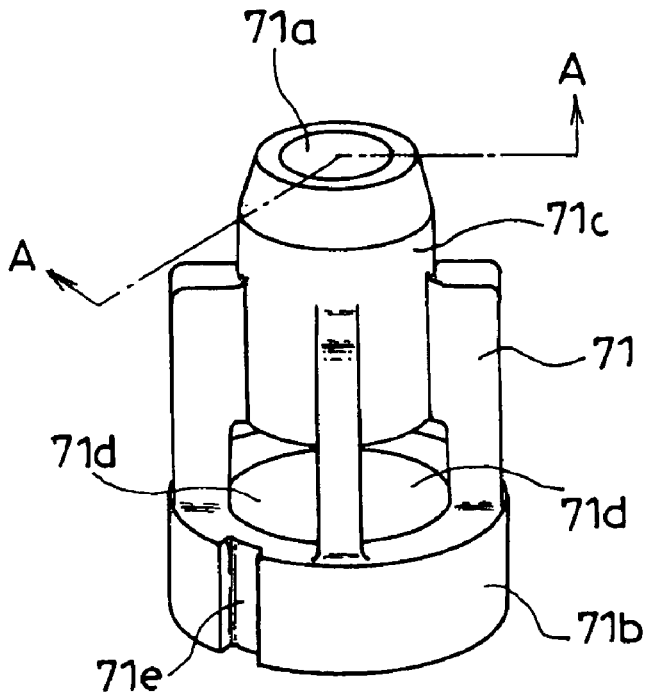
FIG. 5 is a perspective view showing the structure of a piston.
Figure 6:
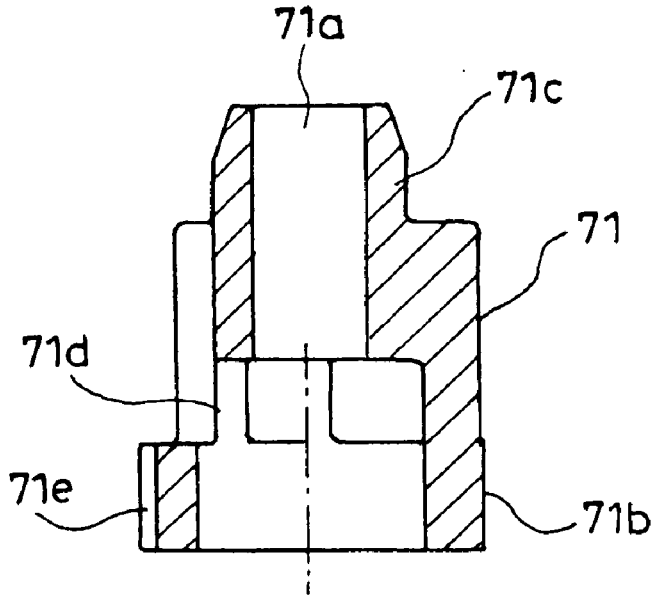
FIG. 6 is a cross-sectional view taking along line A-A of FIG. 5.
Figure 7:
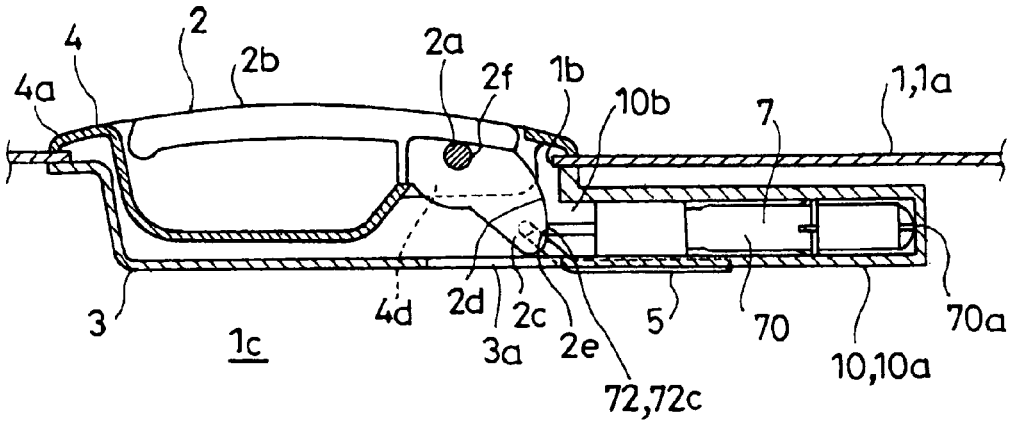
FIG. 7 is a front view showing the structure of the door handle system according to a second embodiment of the present invention.
Figure 8:
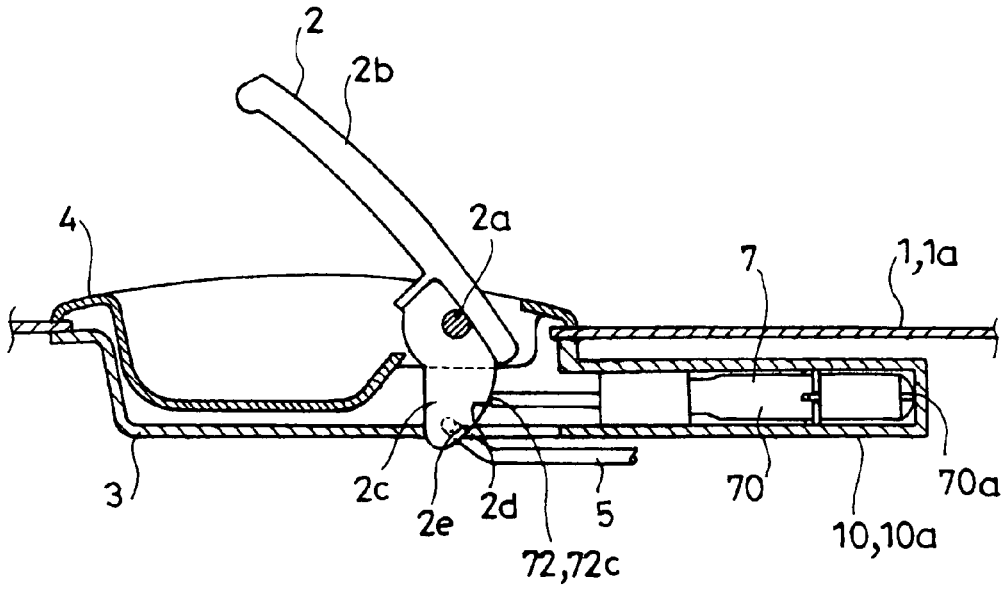
FIG. 8 is a cross-sectional view showing the structure of the door handle system according to the second embodiment.
Figure 9:
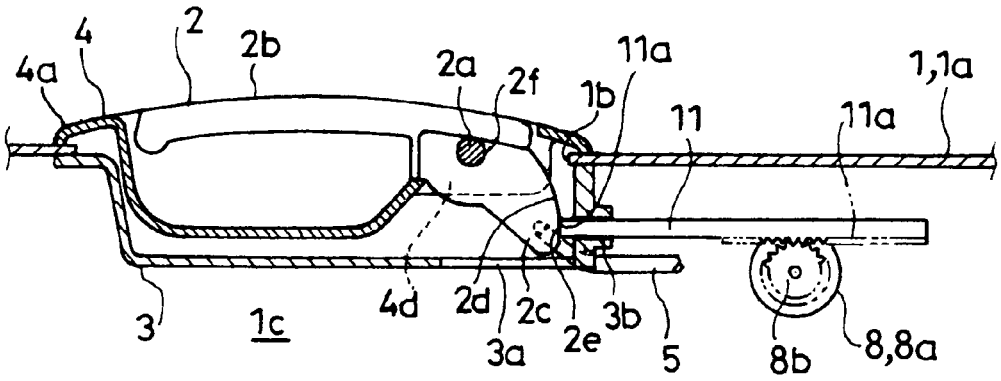
FIG. 9 is a front view showing the structure of the door handle system according to a third embodiment of the present invention.
Figure 10:
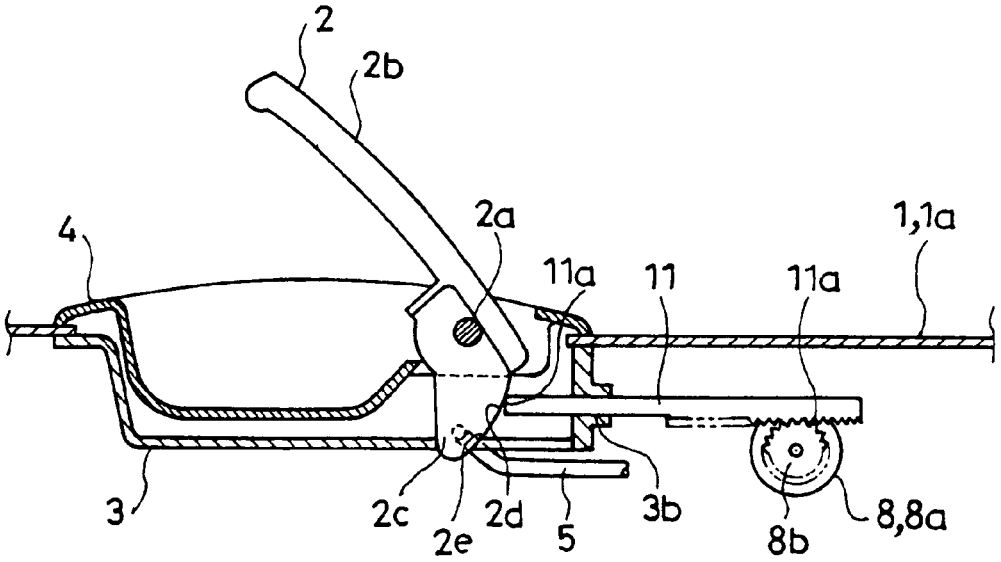
FIG. 10 is a cross-sectional view showing the structure of the door handle system according to the third embodiment.

FIG. 1 to FIG. 3 show the door handle system according to a first embodiment, FIG. 7 and FIG. 8 show the door handle system according to a second embodiment, and FIG. 9 and FIG. 10 show the door handle system according to a third embodiment. FIG. 3, FIG. 8 and FIG. 10 show that door opening levers 2 have been pulled in the respective embodiments. FIG. 4 shows the internal structure of a damper 7 according to the first embodiment and the second embodiment. FIG. 5 and FIG. 6 show a piston 71 forming the damper 7.

The door handle system according to these embodiments is applicable as an inside door handle system disposed at the interior side of an automotive door or as an outside door handle system disposed at the exterior side of an automotive door. The door handle system is configured so that the door opening lever 2 forming a part of the door handle system is prevented from swiftly returning to a position prior to pulling operation when stopping the pulling operation to the door opening lever 2.

The door opening lever 2 is swingably assembled to a door panel 1. The door opening lever is linked to a door latch so as to be capable of opening the door by pulling operation.

The door opening lever 2 has an operating part 2*b* formed on one end thereof and a pressing part 2*c* formed on the other end thereof with respect to a swingable shaft 2*a*.

In each of the shown embodiments, the door opening lever 2 forms a part of an inside door handle system. The swingable shaft 2*a* of the door opening lever 2 is disposed to extend vertically and is configured to have the operating part 2*b* pulled by engaging fingers with the operating part 2*b* from above at the position prior to pulling operation. The door opening lever 2 is biased to be positioned at the position prior to pulling operation by, e.g. an unshown torsion coil spring. In each of the shown embodiments, when the door opening lever 2 is pulled against the biasing action of the torsion coil spring, a connecting rod 5, which is coupled to the pressing part 2*c* of the door opening lever 2, is pulled, causing the door latched by an unshown door latch to be released from an closed state.

In each of the shown embodiments, specifically, the door handle system includes an inner frame 3 and an outer frame 4, which are disposed inside the door panel 1, or an inner panel 1*a* in each of the shown embodiments. The outer frame 4 is formed in a substantially box shape with a front side opened and has the opened side formed with a peripheral flange 4*a*. The outer frame 4 is mounted to the door so as to have an inner portion inside the peripheral flange accommodated inside the inner panel 1*a*, i.e. in an inner space 1*c* of the door in such a state that the peripheral flange 4*a* is brought into press-contact with an edge of a mounting hole 1*b* formed in the inner panel 1*a*. The outer frame 4 has an outer profile and an inner profile, which are formed in a substantially rectangular shape elongated in a width direction of the door. At a position close to one side of the outer frame 4 (a right side of the outer frame in each of the shown embodiments) extending in a width direction thereof, the swingable shaft 2*a* is supported by the outer frame 4 in such a state that the swingable shaft has a top end fixed to an upper wall 4*b* of the outer frame 4 and a bottom end fixed to a lower wall 4*c* of the outer frame 4, and has an intermediate portion positioned in the outer frame 4. The operating part 2*b* of the door opening lever 2 has a length extending throughout a lower portion of the outer frame 4 in the outer frame 4 and is of such a size as to close the lower portion of the outer frame 4 in the position prior to pulling operation. The pressing part of the door opening lever 2 is configured so as to project toward the inner space of the door from the rear side of one end of the operating part 2*b*. The operating part 2*b* and the pressing part 2*c* are connected together at a connecting part, which has a shaft hole 2*f* vertically formed therethrough. By putting the intermediate portion of the swingable shaft 2*a* in the shaft hole 2*f*, the door opening lever 2 is swingably assembled to the outer frame 4, consequently to the door panel 1.

On the other hand, the inner frame 3 is formed in a substantially box shape with a front side opened and is disposed in the inner space of the door so as to have the opening edge brought into press-contact with the edge of the mounting hole 1*b* from an interior side of the inner panel 1*a*. The inner portion of the outer frame 4 inside the peripheral flange 4*a* is accommodated in the inner frame 3. The outer frame 4 and the inner frame 3 have windows 4*d* and 3*d* formed in recessed walls thereof so as to allow the pressing part 2*c* to move therethrough when pulling the door opening lever 2. In the figures, reference numeral 6 designates a lock-nut The pressing part 2*c* of the door opening lever 2 has a surface formed as a cam surface 2*d* thereon so as to face a right wall 4*e* before the door opening lever is pulled, the surface extending along the width direction of the outer frame 4. The cam surface 2*d* is configured so as to have a distance from the swingable shaft 2*a* gradually increasing toward a cam end 2*e*, i.e. the distal end of the pressing part 2*c*. When the door opening lever 2 is set at the position prior to pulling operation, the cam end 2*e* is set at a position in front of an inlet 9*b* of a housing 9 for the damper 7 in the first embodiment described later, at a position in front of an inlet lob of a support 10 for the damper 7 in the second embodiment described later, and at a position in front of an front end of a linearly moving member 11 in the third embodiment described later.

First Embodiment

FIG. 1 to FIG. 6 show an embodiment wherein the door handle system includes the damper 7 and the housing 9 for the damper 7 as not in the other embodiments.

The damper 7 includes a cylinder 70, the piston 71, a piston rod 72 and a biasing member 73 for constantly biasing the piston 71 in a direction away from a depth end 70*a* of the cylinder 70. The damper 7 is configured so as to provide the resistance of a fluid to the retracting movement of the piston 71 against the biasing action, the fluid being sealed in the cylinder 70. Typical examples of the fluid include a viscous fluid, such as silicone oil, or a gas, such as air. In the shown embodiment, an unshown viscous fluid is sealed in the cylinder 70.

The cylinder 70 is formed in a substantially cylindrical shape and has one end opened and the other end closed, the other end forming the depth end 70*a* of the cylinder 70. The depth end 70*a* of the cylinder 70 is formed with a semispherical portion 70*b*. In the shown embodiment, the semispherical portion 70*b* has a top end constantly brought into press-contact with the cam surface 2*d* of the pressing part 2*c* of the door opening lever 2 under the biasing action of the biasing member 73. The semispherical portion 70*b* is formed of a plastic material having a small friction coefficient. The semispherical portion is configured so as not to prevent the door opening lever 2 from swinging, being constantly brought into press-contact with the cam surface 2*d* of the pressing part 2*c* of the door opening lever 2.

The piston rod 72 has an inner end 72*a* (a rod end positioned in the cylinder 70) formed with a cap 74. The piston rod 72 has an intermediate portion formed with a peripheral flange 72*b*, which is spaced from the cap 74. The piston 71 is formed in such a cylindrical shape that a through hole 71*a* is formed in a central portion to pass the piston rod 72 therethrough. The piston is disposed between the cap 74 and the peripheral flange 72*b*, having the piston rod 72 passing through the through hole 71*a*. The piston 71 has a pitch between the cap 74 and the peripheral flange 72*b*, which is longer than the entire length of the piston. The piston 71 is configured so that when the piston rod 72 is retracted or relatively retracted into the cylinder 70, the piston is seated against the peripheral flange 72*b* by the fluid, and that when the piston rod 72 is extended or relatively extended from the cylinder 70, the piston is separated from the peripheral flange 72*b* by the fluid.

The through hole 71*a* of the piston 71 is configured so as to have a larger diameter at an end close to the peripheral flange 72*b* (hereinbelow, referred to as the rear end 71*b* of the piston 71) than the piston rod 72. The rear end 71*b* of the piston 71 has an outline formed in a disc shape in section extending in a direction perpendicular to the central axis thereof, the disc shape having an outer diameter substantially equal to the inner diameter of the cylinder 70. In the rear end 71*b* of the piston 71, the through hole 71*a* is configured so as to be closed by the peripheral flange 72*b* when the piston is seated against the peripheral flange. The piston is configured so as to have a small diameter portion 71*c* between the rear end 71*b* of the piston 71 and an end close to the cap 74 of the piston 71 (hereinbelow, referred to as the leading edge of the piston 71), the small diameter portion being smaller than the inner diameter of the cylinder 70. The small diameter portion 71*c* has a connection portion with the rear end 71*b*, formed with a window 71*d* communicating with the through hole 71*a*. The rear end 71*b* of the piston 71 has a lateral surface formed with a narrow groove 71*e* at each side in the diameter direction. The piston is configured so as to allow the fluid to move through an orifice defined by the narrow groove 71*e* and the inner wall of the cylinder 70 when the piston is seated against the peripheral flange.

In the shown embodiment, the biasing member 73 is formed of a helical compression spring housed between the cap 74 and the inner wall of the depth end 70*a* of the cylinder 70. The open end of the cylinder 70 is closed by an end cap 75, which has a through hole formed in a central portion thereof to pass the piston rod 72 therethrough. The cylinder 70 has a stepped portion 70*c* at a portion close to the open end. The cylinder has an inner liner 76 inserted so as to have a depth end brought into press-contact with the stepped portion, the inner liner housing an accumulator 76*a* formed of a foamed plastic material. The cylinder has an oil seal 77 interposed between the inner liner 76 and the end cap 75 therein. The piston rod 72 is configured so as to extend out of the cylinder 70 to a position to bring the peripheral flange 72*b* into press-contact with the inner liner 76 at the maximum under the biasing action of the spring.

In the shown embodiment, when the piston rod 72 is extended or relatively extended out of the cylinder 70 under the biasing action the spring, the piston 71 is separated from the peripheral flange 72*b* by the resistance of the fluid, and the fluid moves through the window 71*d*. Thus, the damping force applied at the time of extending the piston rod is made small. On the other hand, when the piston rod 72 is retracted or relatively retracted into the cylinder 70 against the biasing action of the spring, the piston is seated against the peripheral flange 72*b* by the resistance of the fluid, and the fluid moves only through the orifice. Thus, the damping force is made great.

In the shown embodiment, the housing 9 for the damper 7 is fixed to the door panel 1. In the shown embodiment, the housing 9 is formed of a cylindrical body 9*a*, which has one end opened and the other end closed, the open end communicating with a space in the inner frame 3. The open end of the cylindrical body 9*a* serves as the inlet 9*b* of the housing 9. The damper 7 is accommodated in the housing 9, the piston rod 72 having an outer end 72*c* fixed to a depth end of the housing 9, i.e. the other end of the cylindrical body 9*a*. The cylindrical body 9*a* has an inner diameter set to be larger than the outer diameter of the cylinder 70. The damper 7 is supported only by fixture of the outer end 72*c* of the piston rod 72 so that the damper has a gap 9*c* formed along the entire circumference of the cylinder 70 between the outer wall of the cylinder 70 and the inner wall of the housing 9. The depth end 70*a* of the cylinder 70 of the damper 7, which is supported as described above, is constantly brought into press-contact with the cam surface 2*d* of the door opening lever 2 under the above-mentioned biasing action. Further, the damper is configured so that a portion of the cam surface 2*d* close to the cam end 2*e* is brought into press-contact with the depth end 70*a* of the cylinder 70 to retract the piston 71 into the cylinder 70 at the maximum when the door opening lever 2 is not subjected to pulling operation (see FIG. 2).

In the shown embodiment, when the door opening lever 2 is pulled, a portion of the cam surface 2*d* close to the swingable shaft 2*a* is positioned in front of the depth end 70*a* of the cylinder 70 with the result that the cylinder 70 moves forward, i.e. moves in a direction to protrude from the housing 9 under the biasing action of the biasing member 73, following the swinging operation of the door opening lever. The damper applies no damping force to the pulling operation 7. When the pulling operation of the door opening lever 2 is stopped, the door opening lever 2 is returned to a position prior to pulling operation. When the door opening lever is returned to the position prior to pulling operation, such a portion of the cam surface 2*d* close to the cam end 2*e* is positioned in front of the depth end 70*a* of the cylinder 70 with the result that the cylinder 70 is retracted, i.e. is moved in a direction to be pressed into the housing 9 against the biasing action of the biasing member 73. In this time, the piston 71 is seated against the peripheral flange 72*b* with the result that the damper 7 applies a damping force to make the returning movement of the door opening lever 2 slow. Even if an internal part in the door handle system is frozen, not only the door opening lever 2 can be pulled without trouble but also the damper 7 can be operated without trouble since the depth end 70*a* of the cylinder 70 forming the damper 7 is simply brought into contact with the cam surface 2*d* of the door opening lever 2 and since the gap 9*c* is formed between the outer wall of the cylinder 70 and the inner wall of the housing 9. In other words, it is possible to prevent the door opening lever 2 from being fixed to the cylinder 70 and prevent the cylinder 70 from being fixed to the housing 9 even if an internal part in the door handle system is frozen.

Second Embodiment

FIGS. 7 and 8 show an embodiment wherein the door hand system includes the damper 7 and the support 10 for the damper 7.

In the second embodiment shown, the damper 7 has the same structure as the damper according to the first embodiment. In the second embodiment, the support 10 for the damper 7 is fixed to the door panel 1. In the second embodiment, the support 10 is formed of a cylindrical body 10*a*, which has one end opened and the other end closed, the open end communicating with the space in the inner frame 3. The open end of the cylindrical body 10*a* serves as the above-mentioned inlet 10*b* of the support 10. The damper 7 is accommodated in the support 10 so that the cylinder 70 is fitted into the support 10 through the inlet 10*b* of the support 10, having its depth end set in a deep position, and that the outer end 72*c* of the piston rod 72 protrudes from the inlet 10*b* of the support 10 into the space in the inner frame 3. The cylindrical body 10*a* has an inner diameter set to be substantially equal to the outer diameter of the cylinder 70. The outer end 72*c* of the piston rod 72 of the damper 7, which is supported as described above, is constantly brought into press-contact with the cam surface 2*d* of the door opening lever 2 under the above-mentioned biasing action. Further, the damper is configured so that a portion of the cam surface 2*d* close to the cam end 2*e* is brought into press-contact with the outer end 72*c* of the piston rod 72 to retract the piston 71 into the cylinder 70 at the maximum when the door opening lever 2 is not subjected to pulling operation (see FIG. 7).

In the second embodiment, when the door opening level 2 is pulled, a portion of the cam surface 2*d* close to the swingable shaft 2*a* is positioned in front of the outer end 72*c* of the piston rod 72 with the result that the piston rod 72 moves forward, i.e. moves in a direction to protrude from the support 10 under the biasing action of the biasing member, following the swinging operation of the door opening lever. The damper 7 applies no damping force to the pulling operation. When the puling operation applied to the door opening lever 2 is stopped, the door opening lever 2 is retuned to a position prior to pulling operation. When the door opening lever is returned to the position prior to pulling operation, such a portion of the cam surface 2*d* close to the cam end 2*e* is positioned in front of the outer end 72*c* of the piston rod 72 with the result that the piston rod 72 is retracted, i.e. is moved in a direction to be pressed into the support 10 against the biasing action of the biasing member 73. In this time, the piston 71 is seated against the peripheral flange 72*b* with the result that the damper 7 applies a damping force to make the returning movement of the door opening lever 2 slow. Even if an internal part in the door hand system is frozen, not only the door opening lever 2 can be pulled without trouble but also the damper 7 can be operated without trouble since the outer end 72*c* of the piston rod 72 forming the damper 7 is simple brought into contact with the cam surface 2*d* of the door opening lever 2 and since the piston rod 72 is not brought into contact with the support 10. In other words, it is possible to prevent the door opening lever 2 from being fixed to the outer end 72*c* of the piston rod 72 and prevent the piston rod 72 from being fixed to the support 10.

Third Embodiment

FIG. 9 and FIG. 10 show an embodiment wherein the door hand system includes the linearly moving member 11, a biasing member for the linearly moving member 11, and a damper 8.

In the third embodiment shown, the linearly moving member 11 is formed in a bar shape. The linearly moving member 11 is configured so as to have one end portion (front end portion 11*a*) passing through a through hole 3*b* formed in the inner frame 3 to be supported by the inner wall of the through hole and to move back and forth, varying a protruding length from the through hole 3*b*, i.e. performing a linear movement. In the third embodiment shown, the linearly moving member 11 has the other end portion formed with a rack 11*a* having a length of not less than the displacement stroke of the linearly moving member 11.

The damper 8 is configured so as to include a main body 8*a* fixed to the door panel 1 and a pinion 8*b* rotatably supported by the main body 8*a* and to provide the resistance of a viscous fluid, such as silicon oil to the rotation of the pinion 8*b*, the fluid being sealed in the main body 8*a*. The damper 8 is fixed in such a position that the pinion 8*b* is constantly engaged with the rack 11*a* of the linearly moving member 11. In the third embodiment, the damper 8 has an unshown torsion coil spring incorporated thereinto to bias the pinion in a direction to constantly press the linear moving member 11 forward. In the third embodiment show, the pinion is counterclockwise biased. Thus, the linearly moving member 11 has the front end portion 11*a* constantly brought into press-contact with the cam surface 2*d* of the door opening lever 2. In other words, in the third embodiment, the unshown spring of the damper 8 serves as the above-mentioned biasing member.

In the third embodiment, the damper is configured so that a portion of the cam surface 2*d* close to the cam end 2*e* is brought into press-contact with the front end portion 11*a* of the linearly moving member 11 to retract the linearly moving member 11 at the maximum when the door opening lever 2 is not subjected to pulling operation (see FIG. 9).

In the third embodiment, when the door opening lever 2 is pulled, a portion of the cam surface 2*d* close to the swingable shaft 2*a* is positioned in front of the front end 11*a* of the linearly moving member 11 with the result that the linearly moving member 11 moves forward under the biasing action of the biasing member, following the swingable operation of the door opening lever. The damper 8 applies no damping force to the pulling operation. In order to cause the linearly moving member 11 to move forward so as to follow the swinging operation of the door opening lever without time lag, it is preferred that the resistance of the fluid be prevented from being strongly applied to the pinion 8*b* of the damper when the pinion 8*b* is rotated in a direction to cause the forward movement. When the pulling operation of the door opening lever 2 is stopped, the door opening lever 2 is returned to a position prior to pulling operation. When the door opening lever is returned to the position prior to pulling operation, such a portion of the cam surface 2*d* close to the cam end 2*e* is positioned in front of the front end 11*a* of the linearly moving member 11 with the result that the linearly moving member 11 is retracted against the biasing action of the biasing member. In this time, the rotation of the pinion 8*b* caused by the retracting movement is damped by the fluid with the result that the returning movement of the door opening lever 2 is made slow. Even if an internal part in the door handle system is frozen, not only the door opening lever 2 can be pulled without trouble but also the damper 8 can be operated without trouble since the front end 11*a* of the linearly moving member 11 forming the damper 8 is simply brought into contact with the cam surface 2*d* of the door opening lever 2. In other words, it is possible to prevent the door opening lever 2 from being fixed to the front end 11*a* of the linearly moving member 11 even if an internal part in the door handle system is frozen.

The entire disclosure of Japanese Patent Application No. 2006-026123 filed on Feb. 2, 2006 including specification, claims, drawings and summary is incorporated herein by reference in its entirety.

The invention claimed is:

1. A door handle system comprising:

a door opening lever swingably assembled to a door panel and configured to be linked to a door latch so as to open a door by a pulling operation;

a damper including a cylinder, a one-piece piston disposed in the cylinder, a piston rod upon which the one-piece piston is slidably disposed, and a biasing member for constantly biasing the one-piece piston in a direction away from a depth end of the cylinder, the damper being configured so as to provide a resistance of a fluid to a retracting movement of the one-piece piston against a biasing action of the biasing member, the fluid being sealed in the cylinder, the one-piece piston comprising:

a large diameter rear end and a small diameter portion integrally connected to the rear end by a plurality of connection portions, at last one window formed in the connection portions which communicate with a first through hole formed in the smaller diameter portion, a groove formed in an external periphery of the large diameter rear end, the groove cooperating with an inner wall of the cylinder to define an orifice, the large diameter rear end having a second through hole therein; and a support for the damper, fixed to the door panel;

wherein the door opening lever has an operating part formed on one end thereof and a pressing part formed on the other end thereof with respect to a swingable shaft, the pressing part having a cam surface, the cam surface being configured so as to have a distance from the swingable shaft gradually increasing toward a cam end;

wherein the damper is configured so that the cylinder is fixed to the support, and that the piston rod has an outer end constantly brought into press-contact with the cam surface of the door opening lever under the biasing action; and wherein the damper is configured so that a portion of the cam surface close to the cam end is brought into press-contact with the outer end of the cylinder to retract the piston into the cylinder at a maximum when the door opening lever is not subjected to the pulling operation.

2. A door handle system according to claim 1, further comprising a peripheral flange fixedly disposed on the piston rod, the peripheral flange being sized to selectively seat against the large diameter rear end and close the second through hole so as to force fluid to pass through the orifice.

3. A door handle system comprising:

a door opening lever swingably assembled to a door panel and linked to a door latch so as to open a door by a pulling operation thereof, the door opening lever having an operating part formed on one end thereof and a pressing part formed on the other end thereof with respect to a swingable shaft, the pressing part having a cam surface with a distance from the swingable shaft gradually increasing toward a cam end;

a damper including a cylinder having an end, a cap disposed in the cylinder, a one-piece piston slidably disposed in the cylinder, a piston rod on which the one-piece piston is slidably disposed, the piston rod having an inner end fixed to the cap and an outer end projecting outwardly from the cylinder, a biasing member disposed between a depth end of the cylinder and the cap to constantly bias the piston rod in a direction away from the depth end of the cylinder, and a fluid sealed in the cylinder, the damper being configured to provide a resistance of the fluid to a retracting movement of the one-piece piston against a biasing action of the biasing member; and a support for the damper, fixed to the door panel, said damper being slidably disposed in the support, wherein the damper is arranged such that a portion of the cam surface close to the cam end is brought into press-contact with the end of the cylinder or the outer end of the piston rod to retract the one-piece piston into the cylinder at a maximum when the door opening lever is not subjected to the pulling operation.

4. A door handle system according to claim 3, wherein the piston rod includes a peripheral flange disposed inside the cylinder so that the one-piece piston slides on the piston rod between the cap and the peripheral flange.

5. A door handle system according to claim 4, wherein the piston includes a rear end having an outer periphery closely contacting an inner periphery of the cylinder and a groove formed at the outer periphery to extend along the piston rod, and a small diameter portion having a diameter less than that of the rear end portion and connected to the rear end with a space therebetween, said small diameter portion having a through hole through which the piston rod passes.

6. A door handle system according to claim 5, wherein the one-piece piston is arranged in the cylinder such that when the piston rod in an extended position is pushed into the cylinder, the rear end of the one-piece piston contacts the peripheral flange to restrict fluid flow passing therethrough, and when the piston rod extends outwardly by the biasing member, the rear end of the one-piece piston is moved away from the peripheral flange to allow the fluid to pass therethrough.

* * * * *